US005362702A

United States Patent [19]

Sam et al.

[11] Patent Number: 5,362,702

[45] Date of Patent: Nov. 8, 1994

[54] DYE RECEIVING PAPER FOR THERMAL TRANSFER PRINTING OF VIDEO SIGNALS

[75] Inventors: Huy Sam, Tokyo; Yoshio Fujiwara, Kanagawa, both of Japan

[73] Assignee: Sony Corporation, Tokyo, Japan

[21] Appl. No.: 944,262

[22] Filed: Sep. 14, 1992

[30] Foreign Application Priority Data

Sep. 19, 1991 [JP] Japan ..... 3-239746

[51] Int. Cl.[5] ..... B41M 5/035; B41M 5/38

[52] U.S. Cl. ..... 503/227; 428/195; 428/211; 428/500; 428/511; 428/521; 428/913; 428/914

[58] Field of Search ..... 8/471; 428/195, 211, 428/500, 521, 511, 913, 914; 503/227

[56] References Cited

U.S. PATENT DOCUMENTS

| | | | |
|---|---|---|---|
| 4,639,751 | 1/1987 | Mori | 503/227 |
| 4,797,310 | 1/1989 | Barby et al. | 428/71 |
| 5,071,823 | 12/1991 | Matsushita et al. | 503/227 |

*Primary Examiner*—B. Hamilton Hess

*Attorney, Agent, or Firm*—Hill, Steadman & Simpson

[57] ABSTRACT

A dye receiving paper forms an image thereon which is represented by a dye contained in an ink which is transferred from an ink ribbon when melted or sublimed with heat. The dye receiving paper includes a dye receiving layer disposed on a sheet base and composed of a resin and a compound added thereto. The compound has an acid anhydride group.

3 Claims, 6 Drawing Sheets

FIG. 2

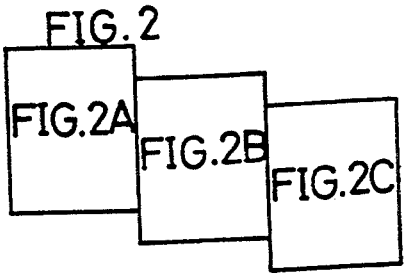

FIG. 2A

Table 1

| | | SPECIMEN NO. | INVENTIVE EXAMPLE | | | | | | | |
|---|---|---|---|---|---|---|---|---|---|---|
| | | | 1 | 2 | 3 | 4 | 5 | 6 | 7 | 8 |
| RESIN | CELLULOSE ESTER | CAB 500-5 E.KODAK | 20 | ← | ← | ← | ← | ← | ← | ← |
| | | CAP 482-05 E.KODAK | | | | | | | | |
| | OTHER RESINS | VINYL ACETATE COPONYL C-5 SEKISUI CHEMICAL CO., LTD. | | | | | | | | |
| | | POLYESTER VYLON 200 TOYOBO CO., LTD. | | | | | | | | |
| | | COPOLYMER OF VINYL CHLORIDE AND VINYL ACETATE VHCH UNION CARBIDE CORP. | | | | | | | | |
| ADDITIVE | COPOLYMER OF MALEIC ANHYDRIDE AND STYRENE | SMA 3000 ATOCHEM INC. | 0.02 | 0.2 | 2 | 5 | | | | |
| | | SCRIPSET 550 (ESTERIZED) MONSANTO CO. | | | | | 2 | | | |
| | COPOLYMER OF MALEIC ANHYDRIDE AND ACRYRILO-NITRILE STYRENE | SUPEREX (IMIDATED) MONSANTO CO. | | | | | | 0.2 | 2 | |
| | COPOLYMER OF MALEIC ANHYDRIDE AND ANOTHER MONOMER | MALEIC ANHYDRIDE VINYL ACETATE FUJI PHOTO FILM CO., LTD. | | | | | | | | 0.2 |
| | OTHERS | ITACONIC ACID ANHY-DRIDE TOKYO KASEI KOGYO CO., LTD. | | | | | | | | |
| | | ALKENYL SUCCINIC ACID ANHYDRIDE | | | | | | | | |
| ANTIOXIDANT | IRGANOX 245 CIBA-GEIGY PLC | | | | | | | | | |
| | MARK PEP-36 ADEKA ARGUS | | | | | | | | | |
| | SUMILIZER GA-80 SUMITOMO CHEMICAL CO., LTD. | | | | | | | | | |

FIG. 2B

Table 1

| INVENTIVE EXAMPLE | | | | | | | | | | | | | | | | | | | |
|---|---|---|---|---|---|---|---|---|---|---|---|---|---|---|---|---|---|---|---|
| 9 | 10 | 11 | 12 | 13 | 14 | 15 | 16 | 17 | 18 | 19 | 20 | 21 | 22 | 23 | 24 | 25 | 26 | 27 | 28 |
| ← | ← | ← | | | | | | | | | | | | | | | | | |
| | | | 20 | ← | ← | ← | ← | ← | | | | | | | | | | | |
| | | | | | | | | | 20 | ← | ← | | | | | | | | |
| | | | | | | | | | | | | 20 | ← | ← | ← | | | | |
| | | | | | | | | | | | | | | | | 20 | ← | ← | ← |
| | | | 2 | | | | | | 2 | | | 2 | | | | 2 | | | |
| | | | | 2 | | | | | | 2 | | | 2 | | | | 2 | | |
| | | | | | 2 | | | | | | | | | | | | | 2 | |
| 2 | | | | | | 2 | | | | | 2 | | | 2 | | | | | 2 |
| | 1 | | | | | | 1 | | | | | | | | 1 | | | | |
| | | 1 | | | | | | 1 | | | | | | | | | | | |
| | | | | | | | | | | | | | | | | | | | |
| | | | | | | | | | | | | | | | | | | | |
| | | | | | | | | | | | | | | | | | | | |

FIG. 2C

Table 1

| | | COMPARATIVE EXAMPLE | | | | | | | | | | | | | | | | | |
|---|---|---|---|---|---|---|---|---|---|---|---|---|---|---|---|---|---|---|---|
| 29 | 30 | 31 | 32 | 33 | 34 | 35 | 36 | 37 | 38 | 39 | 40 | 41 | 42 | 43 | 44 | 45 | 46 | 47 | 48 |
| | | 20 | ← | ← | ← | ← | ← | | | | | | | | | | | | |
| | | | | | | | | 20 | ← | ← | ← | | | | | | | | |
| | | | | | | | | | | | | 20 | ← | ← | ← | | | | |
| | | | | | | | | | | | | | | | | 20 | ← | | |
| ← | ← | | | | | | | | | | | | | | | | | 20 | ← |
| | | | | | | | | | | | | | | | | | | | |
| | | | | | | | | | | | | | | | | | | | |
| | | | | | | | | | | | | | | | | | | | |
| | | | | | | | | | | | | | | | | | | | |
| 1 | | | | | | | | | | | | | | | | | | | |
| | 1 | | | | | | | | | | | | | | | | | | |
| | | | 0.2 | 2 | 5 | | | | 2 | | | | 2 | | | | 2 | | |
| | | | | | | 2 | | | | 2 | | | | 2 | | | | | |
| | | | | | | | 2 | | | | 2 | | | | 2 | | | | 2 |

Table 2

| | SPECIMEN NO. | DYE | TEST MAX. DENSITY | TEST DENSITY OF 1.0 | | SPECIMEN NO. | DYE | TEST MAX. DENSITY | TEST DENSITY OF 1.0 | | SPECIMEN NO. | DYE | TEST MAX. DENSITY | TEST DENSITY OF 1.0 |
|---|---|---|---|---|---|---|---|---|---|---|---|---|---|---|
| INVENTIVE EXAMPLE | 1 | Y | 99.0 | 98.5 | INVENTIVE EXAMPLE | 10 | Y | 100.0 | 100.0 | INVENTIVE EXAMPLE | 19 | Y | 100.0 | 100.0 |
| | | M | 98.5 | 98.0 | | | M | 99.5 | 99.2 | | | M | 99.5 | 99.2 |
| | | C | 95.0 | 94.5 | | | C | 99.0 | 98.3 | | | C | 99.2 | 99.0 |
| | 2 | Y | 100.0 | 100.0 | | 11 | Y | 100.0 | 100.0 | | 20 | Y | 100.0 | 100.0 |
| | | M | 100.0 | 100.0 | | | M | 100.0 | 99.8 | | | M | 100.0 | 100.0 |
| | | C | 99.2 | 98.5 | | | C | 99.6 | 99.5 | | | C | 99.8 | 99.5 |
| | 3 | Y | 100.0 | 100.0 | | 12 | Y | 100.0 | 100.0 | | 21 | Y | 100.0 | 100.0 |
| | | M | 100.0 | 100.0 | | | M | 100.0 | 100.0 | | | M | 100.0 | 99.5 |
| | | C | 100.0 | 100.0 | | | C | 100.0 | 100.0 | | | C | 99.8 | 99.6 |
| | 4 | Y | 100.0 | 100.0 | | 13 | Y | 100.0 | 100.0 | | 22 | Y | 100.0 | 100.0 |
| | | M | 100.0 | 100.0 | | | M | 100.0 | 100.0 | | | M | 99.4 | 99.0 |
| | | C | 100.0 | 100.0 | | | C | 100.0 | 100.0 | | | C | 99.2 | 99.0 |
| | 5 | Y | 100.0 | 100.0 | | 14 | Y | 100.0 | 100.0 | | 23 | Y | 100.0 | 100.0 |
| | | M | 100.0 | 100.0 | | | M | 100.0 | 100.0 | | | M | 100.0 | 100.0 |
| | | C | 100.0 | 100.0 | | | C | 99.7 | 99.2 | | | C | 99.5 | 99.5 |
| | 6 | Y | 100.0 | 100.0 | | 15 | Y | 100.0 | 100.0 | | 24 | Y | 100.0 | 100.0 |
| | | M | 99.1 | 99.0 | | | M | 100.0 | 100.0 | | | M | 99.5 | 99.3 |
| | | C | 99.4 | 98.0 | | | C | 99.8 | 99.5 | | | C | 99.2 | 99.0 |
| | 7 | Y | 100.0 | 100.0 | | 16 | Y | 100.0 | 100.0 | | 25 | Y | 100.0 | 100.0 |
| | | M | 100.0 | 100.0 | | | M | 99.4 | 99.0 | | | M | 100.0 | 100.0 |
| | | C | 99.8 | 99.5 | | | C | 99.0 | 98.2 | | | C | 100.0 | 100.0 |
| | 8 | Y | 100.0 | 100.0 | | 17 | Y | 100.0 | 100.0 | | 26 | Y | 100.0 | 100.0 |
| | | M | 99.2 | 99.0 | | | M | 99.8 | 99.6 | | | M | 99.9 | 99.8 |
| | | C | 99.4 | 98.2 | | | C | 99.6 | 99.5 | | | C | 99.8 | 99.8 |
| | 9 | Y | 100.0 | 100.0 | | 18 | Y | 100.0 | 100.0 | | 27 | Y | 100.0 | 100.0 |
| | | M | 100.0 | 100.0 | | | M | 99.8 | 99.5 | | | M | 100.0 | 100.0 |
| | | C | 100.0 | 99.8 | | | C | 99.6 | 99.6 | | | C | 99.8 | 99.5 |

FIG. 3B

Table 2

| | SPECIMEN NO. | DYE | TEST MAX. DENSITY | TEST DENSITY OF 1.0 | | SPECIMEN NO. | DYE | TEST MAX. DENSITY | TEST DENSITY OF 1.0 | | SPECIMEN NO. | DYE | TEST MAX. DENSITY | TEST DENSITY OF 1.0 |
|---|---|---|---|---|---|---|---|---|---|---|---|---|---|---|
| INVENTIVE EXAMPLE | 28 | Y | 100.0 | 100.0 | COMPARATIVE EXAMPLE | 37 | Y | 85.0 | 84.8 | COMPARATIVE EXAMPLE | 46 | Y | 89.8 | 89.5 |
| | | M | 100.0 | 99.6 | | | M | 80.2 | 80.0 | | | M | 87.3 | 87.2 |
| | | C | 99.8 | 99.6 | | | C | 76.1 | 73.8 | | | C | 85.3 | 84.8 |
| | 29 | Y | 100.0 | 100.0 | | 38 | Y | 89.3 | 87.2 | | 47 | Y | 84.5 | 84.5 |
| | | M | 99.6 | 99.2 | | | M | 83.2 | 84.3 | | | M | 80.3 | 80.1 |
| | | C | 99.2 | 99.0 | | | C | 80.5 | 80.2 | | | C | 75.9 | 74.8 |
| | 30 | Y | 100.0 | 100.0 | | 39 | Y | 87.2 | 87.0 | | 48 | Y | 89.2 | 88.5 |
| | | M | 99.8 | 99.6 | | | M | 84.2 | 84.0 | | | M | 85.3 | 84.9 |
| | | C | 99.6 | 99.2 | | | C | 79.5 | 79.0 | | | C | 82.0 | 80.9 |
| COMPARATIVE EXAMPLE | 31 | Y | 85.2 | 84.2 | | 40 | Y | 88.7 | 88.2 | | | | | |
| | | M | 80.4 | 80.0 | | | M | 85.1 | 84.0 | | | | | |
| | | C | 76.1 | 73.6 | | | C | 80.1 | 78.2 | | | | | |
| | 32 | Y | 87.5 | 85.8 | | 41 | Y | 87.4 | 87.0 | | | | | |
| | | M | 82.1 | 82.1 | | | M | 79.8 | 79.2 | | | | | |
| | | C | 78.2 | 78.0 | | | C | 76.2 | 74.3 | | | | | |
| | 33 | Y | 89.0 | 88.8 | | 42 | Y | 89.1 | 89.0 | | | | | |
| | | M | 84.2 | 84.2 | | | M | 83.4 | 83.2 | | | | | |
| | | C | 80.1 | 80.1 | | | C | 81.2 | 80.8 | | | | | |
| | 34 | Y | 88.5 | 88.2 | | 43 | Y | 88.2 | 88.0 | | | | | |
| | | M | 82.2 | 82.2 | | | M | 84.2 | 83.9 | | | | | |
| | | C | 78.5 | 78.0 | | | C | 80.3 | 80.0 | | | | | |
| | 35 | Y | 87.8 | 87.5 | | 44 | Y | 89.3 | 88.9 | | | | | |
| | | M | 84.6 | 84.0 | | | M | 85.6 | 85.6 | | | | | |
| | | C | 79.5 | 79.2 | | | C | 81.3 | 80.9 | | | | | |
| | 36 | Y | 89.2 | 89.0 | | 45 | Y | 88.7 | 87.8 | | | | | |
| | | M | 86.1 | 86.0 | | | M | 84.2 | 84.0 | | | | | |
| | | C | 80.1 | 79.8 | | | C | 80.2 | 79.8 | | | | | |

DYE RECEIVING PAPER FOR THERMAL TRANSFER PRINTING OF VIDEO SIGNALS

BACKGROUND OF THE INVENTION

1. Field of the Invention

The present invention relates to a dye receiving paper for thermal transfer printing of video signals.

2. Description of the Prior Art

Dye receiving papers for thermal transfer printing of video signals include a dye receiving layer made of polyester, polycarbonate, polyvinyl chloride, a derivative of cellulose ester, or the like. Heretofore, images printed on those dye receiving papers have not been sufficiently resistant to light and dark discoloration, and have not had sufficient storage stability because they are susceptible to light, humidity, oxygen in air, and heat.

To improve the resistance to light and dark discoloration and the storage stability, it has been customary to add an ultraviolet absorbent, an antioxidant, and a stabilizer to the resin of the dye receiving layer.

Nevertheless, the conventional dye receiving papers have not had sufficient wether resistance and storage stability.

OBJECTS AND SUMMARY OF THE INVENTION

In view of the conventional dye receiving papers, it is an object of the present invention to provide a dye receiving paper for thermal transfer printing of video signals, which allows images formed by dye transfer to be highly resistant to dark discoloration and also highly stable in storage.

According to the present invention, there is provided a dye receiving paper for accepting a dye contained in an ink which is transferred when melted or sublimed with heat, for forming an image represented by the dye, comprising a base, and a dye receiving layer disposed on the base and composed of a resin and a compound added thereto, the compound having an acid anhydride group.

The compound comprises a copolymer of a maleic anhydride monomer and a styrene monomer.

Alternatively, the compound comprises a copolymer of a maleic anhydride monomer and at least one of monomers other than the maleic anhydride monomer which include at least a styrene monomer, the maleic anhydride monomer being partially derived.

Further alternatively, the compound comprises a copolymer of a maleic anhydride monomer and at least one of monomers other than the maleic anhydride monomer.

The compound is added in a range from 0.1 to 100 parts by weight with respect to 100 parts by weight of the resin of the dye receiving layer.

The above and other objects, features, and advantages of the present invention will become apparent from the following description of illustrative embodiments thereof to be read in conjunction with the accompanying drawings, in which like reference numerals represent the same or similar objects.

BRIEF DESCRIPTION OF THE DRAWINGS

FIGS. 2A, 2B, and 2C are Table 1 showing the compositions of the dye receiving layers of inventive and comparative examples; and FIGS. 3A and 3B are Table 2 showing the results of a test for checking the resistance to dark discoloration of the inventive and comparative examples.

DETAILED DESCRIPTION OF THE PREFERRED EMBODIMENTS

Figure 1:
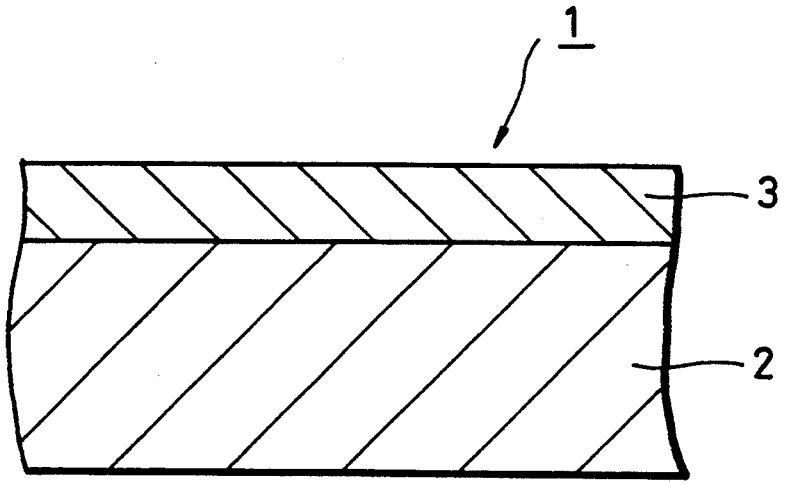
FIG. 1 is a fragmentary cross-sectional view of a dye receiving paper according to the present invention.

FIG. 1 shows in fragmentary cross section a dye receiving paper according to the present invention. The dye receiving paper is used in combination with an ink ribbon having a dye layer containing a dye that can be transferred to the dye receiving paper when melted or sublimed with heat, for thereby printing a video signal on the dye receiving paper.

As shown in FIG. 1, the dye receiving paper, generally designated by the reference numeral 1, comprises a sheet base 2 and a dye receiving layer 3 disposed on a surface thereof for accepting a dye transferred from an ink ribbon. The dye receiving layer 3 is made of one or a mixture of resins including cellulose ester (e.g., cellulose acetate butyrate (CAB), cellulose acetate propionate (CAP), cellulose acetate (CA)), a resin having an ester bond (e.g., polyester, polyacrylate ester, polycarbonate, polyvinyl acetate, styrene acrylate, vinyl toluene acrylate), a resin having a urethane bond (e.g., polyurethane), a resin having an amide bond (e.g., polyamide), a resin having a urea bond, polycaprolactone, polystyrene, polyvinyl chloride and its copolymer, and polyacrylonitrile and its copolymer, and a compound having an acid anhydride group added to the one or mixture of resins.

The compound having an acid anhydride group may be a maleic anhydride monomer, a maleic anhydride monomer homopolymer, or a copolymer of a maleic anhydride monomer and one or more of monomers of styrene, vinyl acetate, vinylene chloride, acrylate, acrylonitrile, diallyl phthalate, butadiene, methyl ether, and ethylene.

Of particular importance among the above compound materials for the present invention is a copolymer of a maleic anhydride monomer and a styrene monomer. It is preferable that the copolymer have a number-average molecular weight of several hundreds or more, and the molar ratio of maleic anhydride and styrene be 1 or less.

Alternatively, a copolymer which is derived from the acid anhydride group of the above copolymer through partial monoesterification, diesterification, amidation, or imidation thereof, or addition of epoxy thereto may be used singly or in combination with the above copolymer for the compound for equivalent results.

The compound having an acid anhydride group should be added in 0.1 to 100 parts with respect to 100 parts of the principal resin of the dye receiving layer. It has been recognized that if the compound were added in less than 0.1 part, then the dye receiving layer 3 would be of reduced weather resistance, and that if compound were added in less than 0.1 part, then the dye receiving layer 3 would be poor in other properties than weather resistance.

The compound having an acid anhydride group may further be composed of succinic acid anhydride and its derivative (e.g., alkyl, alkenyl succinic acid anhydride; n-decyl succinic acid anhydride, n-dodecenyl succinic acid anhydride, or the like), phthalic anhydride and its derivative, trimellitic acid anhydride and its derivative, itaconic acid anhydride and its derivative, maleic oil, maleic rosin, maleic acid resin, or maleic petroleum resin. These compounds may be used singly or in combination with a copolymer of a maleic anhydride monomer and a styrene monomer for equivalent results.

Various esters, ethers, and hydrocarbon compounds may be used as an additive which is compatible with cellulose esters for increasing the dyeability of the dye and improving the light resistance and heat resistance of the dye. These esters, ethers, and hydrocarbon compounds are considered to be compatible with cellulose esters to form an amorphous state for accelerating the diffusion of the dye to allow the dye to penetrate into the dye receiving layer. Those which have a melting point ranging from −50° C. to 150° C. and are in a liquid or solid phase can all be used as the additive.

Examples of the esters are a phthalic acid ester such as dimethyl phthalate, diethyl phthalate, dioctyl phthalate, dicyclohexyl phthalate, diphenyl phthalate, or the like, an aliphatic dibasic acid ester such as dioctyl adipate, dioctyl sebacate, dicyclohexyl azelate, or the like, a phosphoric ester such as triphenyl phosphate, tricyclohexyl phosphate, triethyl phosphate, or the like, an isophthalic acid ester such as dimethyl isophthalate, diethyl isophthalate, dicyclohexyl isophthalate, or the like, a higher fatty acid ester such as butylstearate, cyclohexyl laurate, or the like, a silicic acid ester such as tetraethyl silicate, tetraphenyl silicate, or the like, and a boric acid ester such as tributyl borate, triphenyl borate, or the like.

Examples of the ethers are diphenyl ether, dicyclohexyl ether, and P-ethoxy methyl ester benzonate. Examples of the hydrocarbon compounds are camphor, low-molecular polystyrene, a phenol such as P-phenylphenol, O-phenylphenol, or the like, and a sulfonamide such as N-ethyl toluenesulfonamide or the like.

A fluorescent brightener and a white pigment may be added to the dye receiving layer 3 to increase the whiteness degree of the dye receiving layer 3 for increased image sharpness, to add writing quality to the paper surface, and to prevent transferred images from being transferred back to the ink ribbon.

The fluorescent brightener may be one of many compounds sold as fluorescent brighteners, such as Uvitex OB manufactured by Ciba-Geigy PLC. The white pigment may be titanium oxide, zinc oxide, kaolin, clay, calcium carbonate, fine-powder silica, or the like. These materials may be used singly or two or more of these materials may be mixed for use as the white pigment. To increase the light resistance of transferred images, there may be added to the dye receiving layer 3 one or more of additives including an ultraviolet absorbent, a light stabilizer, and an antioxidant. The fluorescent brightener, the white pigment, the ultraviolet absorbent, and the light stabilizer are added in 0.05 to 10 parts by weight with respect to 100 parts by weight of the resin of cellulose ester. Depending on the application, however, these additives may be added in an amount other than the above range. Therefore, the above range for the addition of the additives is given for illustrative example only, and the present invention should not be limited to the described range.

The dye receiving paper 1 may further contain a parting agent in the dye receiving layer 3 for easily separating the dye receiving layer 3 from the ink ribbon. The parting agent may be a solid wax such as polyethylene wax, amide wax, Teflon powder, or the like, a surface active agent of fluorine or phosphoric ester, silicone oil, a silicone wax of high melting point, but should preferably be silicone oil.

The silicone oil may be in an oily form or of a reactive (setting) type depending on the application. The reactive (setting) type silicone oil may be alcohol-modified silicone oil or isocyanate. Alternatively, the reactive (setting) type silicone oil may also be epoxy-modified silicone oil (epoxypolyether-modified silicone oil) and carboxy-modified silicone oil (carboxypolyether-modified silicone oil) which are set through reaction with each other, or amino acid silicone oil (aminopolyether-modified silicon oil) and carboxy-modified silicone oil (carboxypolyether-modified silicone oil) which are set through reaction with each other. The parting agent may be added in the form of a layer which should preferably, but not necessarily, be of a thickness in the range from 0.01 to 5 μm.

To prevent the dye receiving paper 1 from developing electrostatic charges when it is processed or traveling through a printer, the antistatic agent may be contained in the resin of cellulose ester or the dye receiving layer 3, or added to the surface of the dye receiving layer 3.

The antistatic agent may be a surface active agent such as a cationic surface active agent (e.g., quaternary ammonium salt, polyamine derivative, or the like), an anionic surface active agent (e.g., alkylbenzenesulfonate, alkylsulfuric ester sodium salt, or the like), an ampholytic surface active agent, or a nonionic surface active agent.

The antistatic agent may be coated on the surface of the dye receiving layer 3 or added to the resin of cellulose ester.

Figures 3, 3A:
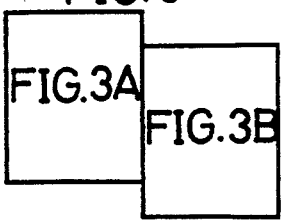

Inventive examples of the dye receiving paper according to the present invention and comparative examples will be described below with reference to FIGS. 1, 2A through 2B, 3A and 3B. FIGS. 2A through 2B show Table 1, and FIGS. 3A and 3B show Table 2.

An ink ribbon (manufactured by Sony under the tradename of "Ink Ribbon VPM-30ST") containing dyes of yellow (Y), magenta (M), and cyan (C), and a dye receiving paper according to the present invention were used to effect stairstep printing of 12 gradations on a color video printer (manufactured by Sony under the tradename of "CVP-G500").

The dye receiving paper was manufactured by coating a synthetic paper having a thickness of 150 μm (manufactured by Oji-Yuka Synthetic Paper Co., Ltd. under the tradename of "FPG-150") with a dye receiving layer such that its dried thickness would be 10 μm, and curing the coated synthetic paper at 50° C. for 48 hours. The dye receiving layer had the following composition:

Resin: 20.0 parts by weight (see Tables 1 and 2);

Compound having an acid anhydride group: 0~20 parts by weight;

Compound for increasing the dyeability (dicyclohexyl phthalate): 10 parts by weight (manufactured by Osaka Organic Chemical Industry Ltd.);

Isocyanate: 1.0 parts by weight (manufactured by Takeda Chemical Industries, Ltd under the tradename of "Takenate D-110N);

Modified silicone oil: 0.6 parts by weight (manufactured by Toray Dow Corning, Ltd. under the tradename of "SF8427");

Fluorescent brightener: 0.04 parts by weight (manufactured by Ciba-Geigy PLC under the tradename of Uvitex OB); and Methylethyl ketone: 40 parts by weight.

A test was conducted on the specimens of the inventive and comparative examples to check their resistance to dark discoloration. In the test, the dye receiving papers of the specimens printed in gradations were left at rest in an air-conditioned tank (manufactured by Tabai) at 60° C. and 80% RH for 14 days. Thereafter, using the Macbeth reflection densitometer (TR-924), density changes in areas of the maximum density and the density of about 1.0 on the dye receiving papers were measured, and the percentages of the remaining dye were calculated according to the following equation:

Percentage of the remaining dye (%) = Density after the test/density before the test × 100.

The results of the test are given in Table 2 shown in FIGS. 3A and 3B.

As can be seen from Table 2, through the addition of compounds having acid anhydride groups to the resins of the dye receiving layers, the resistance to dark discoloration and the storage stability of the printed images were made much higher with the dye receiving papers according to the inventive examples 1 through 30 than with the dye receiving papers according to the comparative examples 31 through 48 which included conventional antioxidants.

The increases in the resistance to dark discoloration and the storage stability were not limited to any color, but confirmed uniformly with respect to all the colors of yellow (Y), magenta (M), and cyan (C). The increases in the resistance to dark discoloration and the storage stability were also seen with respect to different resins used in the dye receiving layers.

Having described preferred embodiments of the invention with reference to the accompanying drawings, it is to be understood that the invention is not limited to that precise embodiments and that various changes and modifications could be effected by one skilled in the art without departing from the spirit or scope of the invention as defined in the appended claims.

What is claimed is:

1. A dye receiving sheet for accepting a dye contained in an ink which is transferred when melted or sublimed with heat, in combination with an ink donor material, said dye receiving sheet comprising:

a base sheet consisting of paper or plastic film; and a dye receiving layer disposed on said base sheet and composed of a resin and a compound added thereto, said compound having an acid anhydride group and comprising a copolymer of a maleic anhydride monomer and at least one of monomers other than said maleic anhydride monomer which includes at least a styrene monomer, said maleic anhydride monomer being chemically modified by monoesterification diesterification, amidation, or imidation.

2. A dye receiving paper according to claim 1, wherein said compound is added in a range from 0.1 to 100 parts by weight with respect to 100 parts by weight of said resin of the dye receiving layer.

3. A process of imaging a dye receiving sheet with an ink donor material, comprising the steps of:

contacting a dye receiving sheet with an ink donor material containing dye, said dye receiving sheet comprising a base sheet consisting of paper or plastic film and a dye receiving layer disposed on said base sheet and composed of a resin and a compound added thereto, said compound having an acid anhydride group and comprising a copolymer of a maleic anhydride monomer and at least one of monomers other than said maleic anhydride monomer which includes at least a styrene monomer, said maleic anhydride monomer being chemically modified by monoesterification, diesterification, amidation, or imidation; and transferring said dye from the ink donor material to the dye receiving sheet by melting or subliming with heat.

* * * * *